United States Patent [19]

Schimanski

[11] 4,301,556

[45] Nov. 24, 1981

[54] HOLDER FOR TOILET DEODORANTS

[76] Inventor: Georg Schimanski, Bührener Weg 41, 5800 Hagen 8-Dahl, Fed. Rep. of Germany

[21] Appl. No.: 133,874

[22] Filed: Mar. 25, 1980

[30] Foreign Application Priority Data

Apr. 27, 1979 [DE] Fed. Rep. of Germany ..... 2917083

[51] Int. Cl.[3] ..... E03D 9/02

[52] U.S. Cl. ..... 4/231; 4/228

[58] Field of Search ..... 4/231, 222, 232, 229, 4/228

[56] References Cited

U.S. PATENT DOCUMENTS 3,529,309 9/1970 Leavitt et al. ..... 4/231

3,766,576 10/1973 Ancel ..... 4/231

4,143,431 3/1979 Goncalves ..... 4/231

4,168,551 9/1979 Hautmann et al. ..... 4/231

*Primary Examiner*—Henry K. Artis

*Attorney, Agent, or Firm*—Jacobs & Jacobs

[57] ABSTRACT

Holder for toilet deodorants and other cleaning and active substances wherein the holder is made in a single piece from plastic by plastic shaping or forming as by injection molding. The holder comprises a basket for the replaceable reception of the active substance and means for hanging the basket over a toilet bowl to grip the edge of the same. The basket is provided with a variety of flexible arm constructions to make it mersatile for use under a plurality of conditions with a number of differently constructed bowls.

6 Claims, 9 Drawing Figures

HOLDER FOR TOILET DEODORANTS

The present invention relates to a holder for toilet deodorants and other cleaning or active substances made in a single piece from plastic by plastic shaping or forming and particularly by injection molding. The holder consists of a basket for the replaceable reception of the active substances and a hanging device formed on the basket which extends above it and grips around the edge of a toilet bowl.

In one known support of this type a hook-shaped suspension device is formed on a basket by means of a breakable connection which must be brokgn off from the basket before the holder is used. The shank of such hook-shaped hanging device must then be passed through an insertion opening formed on the basket, the connection being secured at least by friction but in most cases by notches formed thereon which make it possible for the shaft to be adjusted in lengthwise direction in order to change as desire, the effective length of the hanging device.

This has the advantage, to be sure, that the hanging device can be adapted to the corresponding height of the inward protruding edge of the toilet bowl, but the steps which must be carried out for this purpose by the user in order to apply and use the support are relatively inconvenient and complicated.

The main object of the present invention is to obtain, by the simplest means, substantial simplification of the steps and structure required for the use of a holder of the above-indicated type.

In addition, it is also to make it possible to manufacture the holder by means of the simplest molding tools.

These objects are achieved in accordance with the present invention in such manner that the hanging device has two arms, constructed in non-detachable manner on the basket, which extend upwardly from the basket away from each other and can be urged elastically towards each other and a hook with its hook-mouth facing the basket adjoining the upper end portions of each of said arms.

In this way, there is obtained a holder in which the effective length of the hanging device required at any time can be adapted with infinite variation to the corresponding height of the inward-protruding edge of the toilet bowl merely by pushing the arms towards each other. Another advantage is furthermore that, after release of the elastically prestressed arms of the holder hung on the edge of the toilet bowl, the basket is pressed positively, namely by the spring force of the arms, against the bottom of the inwardly-protruding edge of the toilet bowl and is contained there in correct position without the user having to carry out any operations whatsoever for this purpose.

An advantageous further development of the object described above which serves to assist the spring force of the arms consists therein that the end parts of the two hooks are arranged to approach each other in the direction towards the basket and passing into each other, with approximately the same angle of spread as the arms and are constructed to be elastically bendable towards each other in the same way as the arms, in which connection furthermore the arms and the interconnected hook parts are preferably arranged so as to each enclose an angle of about 90°, the angle bisectors in particular furthermore being arranged so as to extend at right angles to the top of the basket.

In order to be able to produce the above-mentioned support by means of a simple 2-part mold, in particular by injection molding, the hanging device should be so arranged on the basket that the projection of the hanging device lies outside the structure of the basket.

Furthermore as shown in FIG. 9, there is the further advantage that the basket is formed with the arms projecting therefrom. It thus becomes possible for the basket to be folded or stored in a relatively small space, in which condition it remains in a self-supporting upright position with provision for the projection behind which the side piece extends closely thereunder and flexibly toward an outer self-engaged seat. As soon as the holder is removed from its storage space for use, the side pieces are manually unseated and pressed outwardly and thus removed from the engaged position.

In the holder of the invention, which is formed of a single piece of plastic by injection molding, two upwardly extending arms 2 and 3 which extend away from each other are formed on one longitudinal side of a substantially parallelepiped-shaped basket 1 which is arranged on edge and with its top side open, said arms 2 and 3, which can be urged elastically towards each other, forming in their relaxed or rest condition an angle of spread of about 90°. Adjoining the two arms 2 and 3 there are provided top hooks 4 and 5 respectively, with the hook mouth open toward the mouth of the basket.

The parts 6 and 7 of the hooks 4 and 5, respectively, which face away from the arms are directed so as to approach each other and extend into each other, the angle enclosed by the parts 6 and 7 being greater than the angle formed by the arms 2 and 3.

Figure 1:
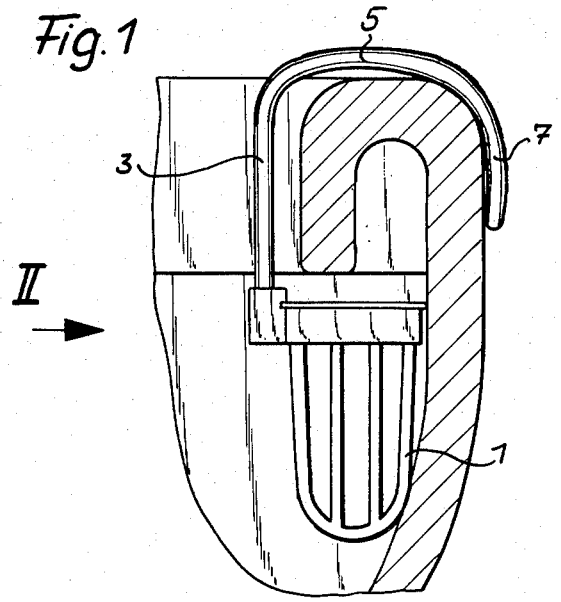
FIG. 1 illustrates in side view a holder suspended from the edge of a toilet bowl and intended to receive toilet deodorizing and cleaning or other active substances.
Figure 2:
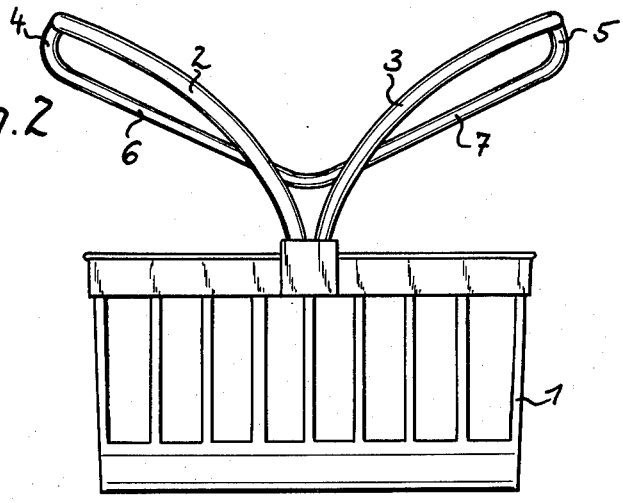
FIG. 2 is a view thereof taken in the direction of the arrow II of FIG. 1.
Figure 3:
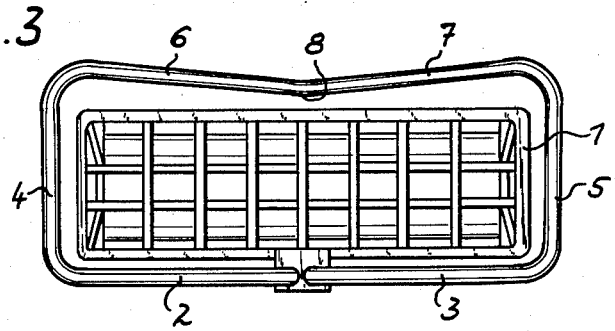
FIG. 3 is a view thereof seen from above.
Figure 4:
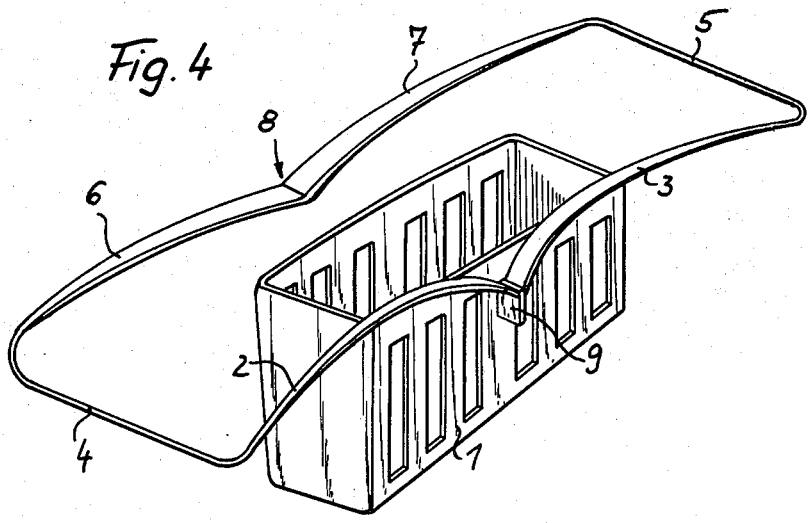
FIGS. 4 and 5 are perspective views of further embodiments.

As can be observed from FIG. 4, the hanging device (parts 2 to 7), which is made integral with the basket 1, is so arranged that the projection of the hanging device in the relaxed or rest condition lies outside the projection of the basket 1 so that the entire support can be produced by means of a single 2-part mold.

It is also possible to arrange the connection of the arms 2 & 3 to the basket 1 at a distance from the mouth of the basket.

The corner 8 which is formed by the parts 6 and 7 can be developed so as to extend up to the mouth of the basket 1 and be manufactured attached by a point of intended breakage to the basket.

Figure 5:
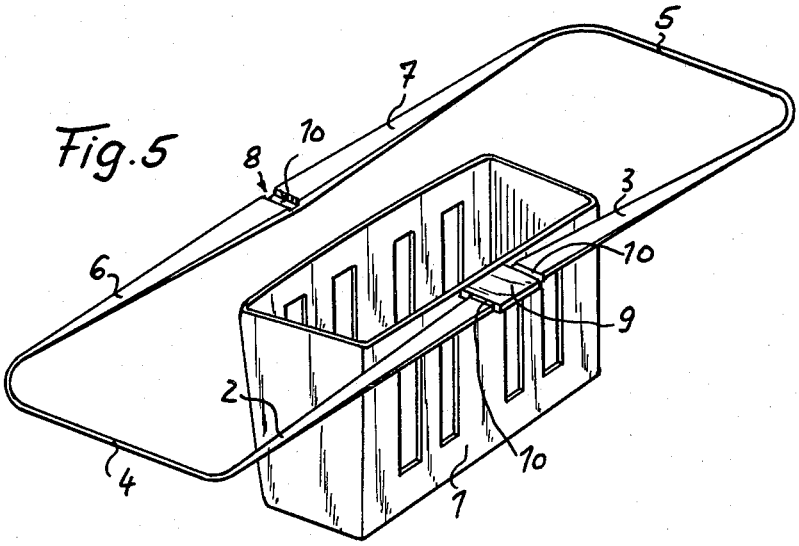

In the embodiments shown in FIGS. 4 and 5, the arms 2 and 3 as well as the hook parts 6 and 7 are of rectangular cross-section over their entire length, the long cross-sectional sides being arranged to extend parallel to the mouth of the basket 1 and the edges being optionally rounded to a greater or lesser extent.

Furthermore, the width of the parts 2 and 3 and the hook parts 6 and 7 which in the region of their attachment 9 and of the corner 8, respectively, extend obliquely upwardly and form approximately an obtuse angle with each other, are curved in an arc in such a manner that the parts 4 and 5 lie approximately in the same plane as the mouth of the basket.

In this connection the radius of curvature increases with increasing distance from the corner 8 and the point of connection 9 respectively.

In FIG. 5, the arms 2 and 3 as well as the hooks 4 and 5 and their hook parts 6 and 7 all extend in the plane of the opening of the basket. In the regions of the corner 8 and of the arm attachment there are provided reductions 10 in cross-section such as to form film hinges so that, in this embodiment also, which can be produced in a particularly simple mold, the arms 2 and 3 and the hook parts 6 and 7 can be relatively easily pressed elastically towards each other.

Figure 6:
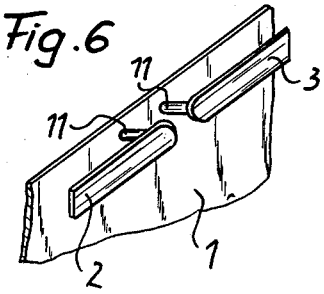
FIGS. 6 and 7 illustrate in perspective variants of details.
Figure 7:
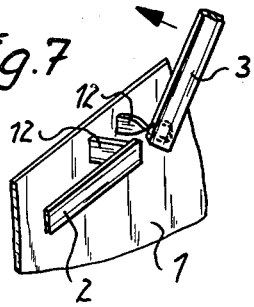

In the embodiments which have been shown only in part in FIGS. 6 and 7 the arms 2 and 3 are connected in non-detachable manner to the basket 1 by means of torsion springs 11 and 12 which are formed thereon (FIG. 7), the springs 11 being of round cross-section while the springs 12 are polygonal in cross-section and in particular of rectangular cross-section.

The torsion spring associated with the arm 3 is shown turned out of its original position and thus with initial spring stress.

Figure 8:
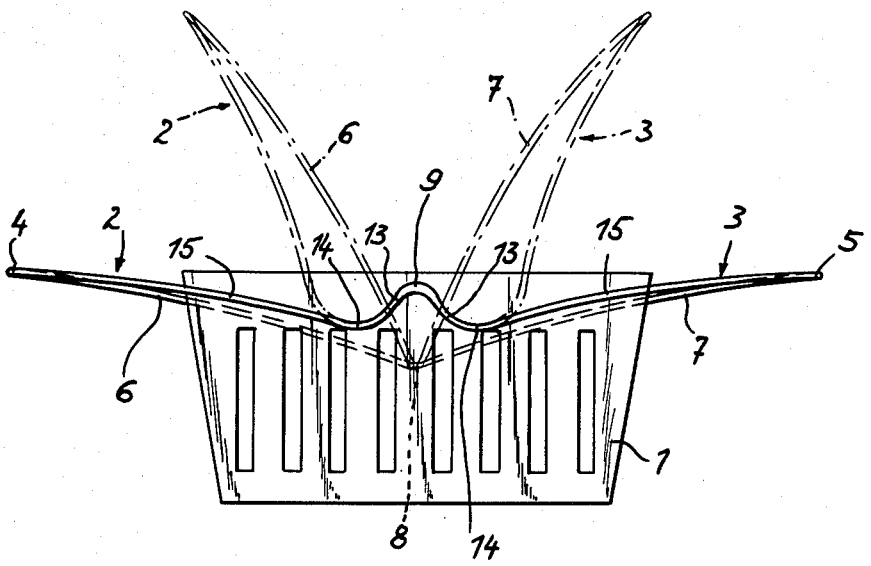
FIG. 8 is a front view of still another embodiment.
Figure 9:
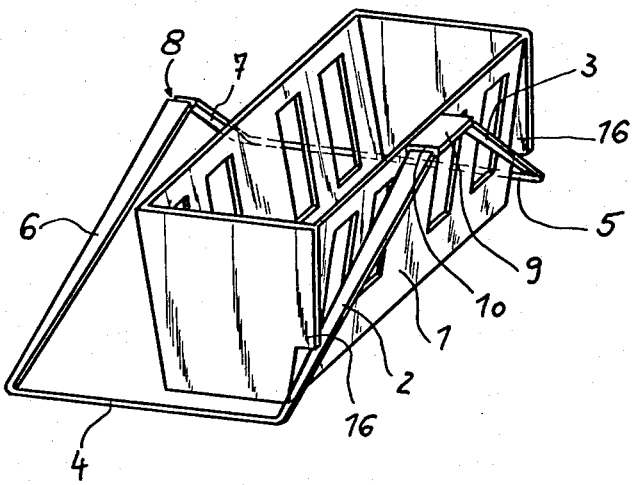
FIG. 9 is a further embodiment shown in perspective.

The embodiment shown in FIG. 8 has arms 2 and 3 developed on a channel-shaped profiled attachment 9, the flanges of the attachment 9 being directed obliquely downward.

The arms 2 and 3 have first of all zones 13 which in each case follow the directions of the flanges adjoining which zones there is in each case an upward-tending arc 14 which passes into a zone 15 which is bent in the direction opposite to that of the arc 14.

In dot-dash lines the position of use of the hanging device for hanging on the edge of a toilet bowl is shown.

From both showings it is clear that this shape of the arms 2 and 3 results in large spring paths and relatively large spring forces.

The foregoing is intended as illustrative and not as limitative and within the terms and scope of the appended claims other and further forms of the invention may be made.

I claim:

1. Holder for toilet deodorizing and cleaning and other active substances produced in one piece by plastic deformation, particularly by injection molding, consisting of a basket for the replaceable reception of the active substance and a hanging device formed centrally of one longitudinal side of the basket and which extends above the basket and grips around the edge of a toilet bowl, the hanging device having two arms which extend away from each other and are undetachably formed on the basket, extend upwardly from one centrally positioned location of the basket and, while moving away from each other, can be elastically urged towards each other, and top hooks arranged with the mouth of the hooks open towards the mouth of the basket and adjoining each of the upper end parts of the arms.

2. A holder according to claim 1, wherein the end portions of the two hooks are arranged so as to approach each other in the direction of the basket and to pass into each other with approximately the same angle of spread as the arms and, in the same manner as the arms, are also constructed so as to be elastically bendable towards each other.

3. A holder according to claim 2, wherein the arms and the hook portions which connect them together, are arranged at an angle of about 90°, the angle bisectors in particular furthermore extending at a right angle to the top of the basket centrally of one side thereof.

4. A holder according to claim 3, wherein the hanging device extends beyond and outside of the periphery of the basket.

5. A holder according to claim 4 wherein the basket is formed with its arms projecting rearwardly therefrom.

6. A holder according to claim 1, wherein the basket is parallelepiped-shaped with solid end walls and apertured longitudinal side walls.

* * * * *